United States Patent [19]

Pettersson

[11] Patent Number: 4,545,721

[45] Date of Patent: Oct. 8, 1985

[54] COMBINED LIFT FORK AND BUCKET DEVICE FOR ATTACHMENT TO A VEHICLE

[76] Inventor: Stig Pettersson, Västtjärn 750, S-825 00 Iggesund, Sweden

[21] Appl. No.: 590,588

[22] PCT Filed: May 4, 1983

[86] PCT No.: PCT/SE83/00178

§ 371 Date: Jan. 3, 1984

§ 102(e) Date: Jan. 3, 1984

[87] PCT Pub. No.: WO83/04062

PCT Pub. Date: Nov. 24, 1983

[30] Foreign Application Priority Data

May 7, 1982 [SE] Sweden ..... 8202897
Apr. 7, 1983 [SE] Sweden ..... 8301933

[51] Int. Cl.[4] ..... B66F 9/16

[52] U.S. Cl. ..... 414/724; 37/117.5; 37/DIG. 3; 414/607; 414/912

[58] Field of Search ..... 37/117.5, DIG. 3, DIG. 12; 414/724, 607, 912

[56] References Cited

U.S. PATENT DOCUMENTS

| | | | |
|---|---|---|---|
| 2,670,865 | 3/1954 | Merrick | 419/607 X |
| 2,762,518 | 9/1956 | Streb et al. | 414/607 |
| 2,764,307 | 9/1956 | Kughler | 414/607 |
| 3,013,684 | 12/1961 | King et al. | 414/607 |
| 3,032,220 | 5/1962 | Love | 414/607 |
| 3,115,261 | 12/1963 | Antolini | 414/607 |
| 3,348,715 | 10/1967 | Kretz | 414/724 X |
| 3,375,595 | 4/1968 | Beltrami | 37/186 X |
| 3,498,489 | 3/1970 | Love | 414/607 |
| 3,959,900 | 6/1976 | Luck | 37/117 S |
| 4,077,529 | 3/1978 | Leyrat et al. | 37/DIG. 3 |

FOREIGN PATENT DOCUMENTS

| | | | |
|---|---|---|---|
| 2931864 | 2/1980 | Fed. Rep. of Germany | 414/607 |

*Primary Examiner*—Clifford D. Crowder
*Attorney, Agent, or Firm*—LeBlanc, Nolan, Shur & Nies

[57] ABSTRACT

A device at a bucket (25,30), for example a so-called gravel bucket or transport bucket, which bucket is intended to be attached to a tractor or corresponding vehicle and be carried by preferably two lifting arms extending in parallel with each other, and where preferably hydraulic means are provided for controlling said lifting arms and said bucket so that the bucket can be lifted and lowered in a substantially vertical plane and be tipped. The device is especially characterized in that a lifting fork (21) or corresponding member is provided and intended to be carried by said lifting arms or corresponding members, which lifting fork (21) is mounted pivotal by preferably hydraulic means so that the arms (20) or corresponding members of the fork (21) can be pivoted in planes substantially perpendicular to the width direction of the bucket (25,30), and located substantially beneath said bucket (25,30). A further characterizing feature is that the bucket or portions (30) of the bucket (25,30) are capable, preferably by hydraulic means (40) to be folded to and from the fork (21) between a first and a second position, whereby the bucket (25,30), preferably resting on the fork (21), or the fork (21) can be utilized.

13 Claims, 8 Drawing Figures

COMBINED LIFT FORK AND BUCKET DEVICE FOR ATTACHMENT TO A VEHICLE

This invention relates to a device at a bucket, for example a so-called gravel bucket or corresponding one, intended to be attached to a tractor or corresponding vehicle, comprising preferably two lifting arms capable to carry said bucket, where preferably hydraulic means are provided for controlling said lifting arms and said bucket, so that the bucket can be lifted up and lowered in a substantially vertical plane and be tipped.

Buckets of this kind carried on tractors and corresponding vehicles are used for excavating and transporting, for example gravel etc. Certain applications, however, for which the carrying vehicle, the tractor, per se would be suitable, cannot be carried out with a bucket. This applies, for example, to the lifting and transport of pallets and to the lifting and transport of cement pipes or the like. In such cases, fork trucks are used instead. It is, of course, possible to remove the bucket and exchange it for a lifting fork or the like, which requires normally tedious and stressing manual work.

The present invention relates to a combined excavating bucket and lifting fork, whereby a substantially higher flexibility in respect of the application range of the device is obtained. The device can be adjusted automatically for changing the field of application, i.e. for applying the bucket or the fork.

The present invention, thus, relates to a device at a bucket, for example a so-called gravel bucket or transport bucket, which bucket is intended to be attached to a tractor or corresponding vehicle and is carried by preferably two lifting arms extending in parallel with each other, and where preferably hydraulic means are provided for controlling said lifting arms and said bucket, so that the bucket can be lifted up and lowered in a substantially vertical plane and be tipped.

The device according to the invention is especially characterized in that a lifting fork or corresponding member is provided and intended to be carried by said lifting arms or corresponding members, which lifting fork is pivotal by preferably hydraulic means, so that the arms or corresponding members of the fork can be pivoted in planes substantially perpendicular to the width direction of the bucket, which lifting fork is located substantially beneath said bucket, and that the bucket or parts thereof are capable, preferably by hydraulic means, to be folded to and from the fork between a first and a second position, whereby the bucket, preferably resting on the fork, or the fork can be utilized.

Figure 1:
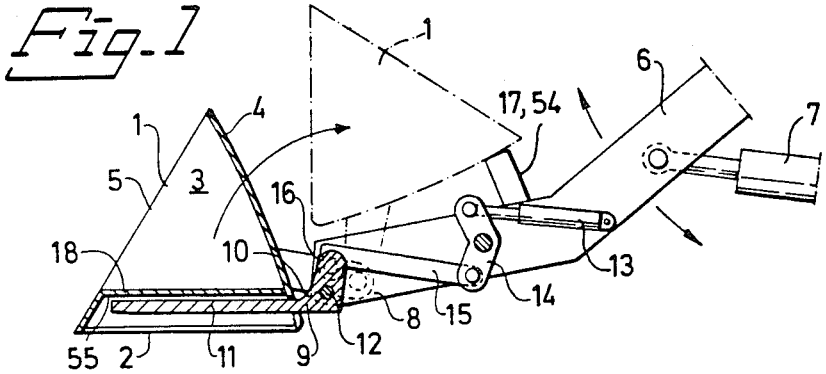
Figure 2:
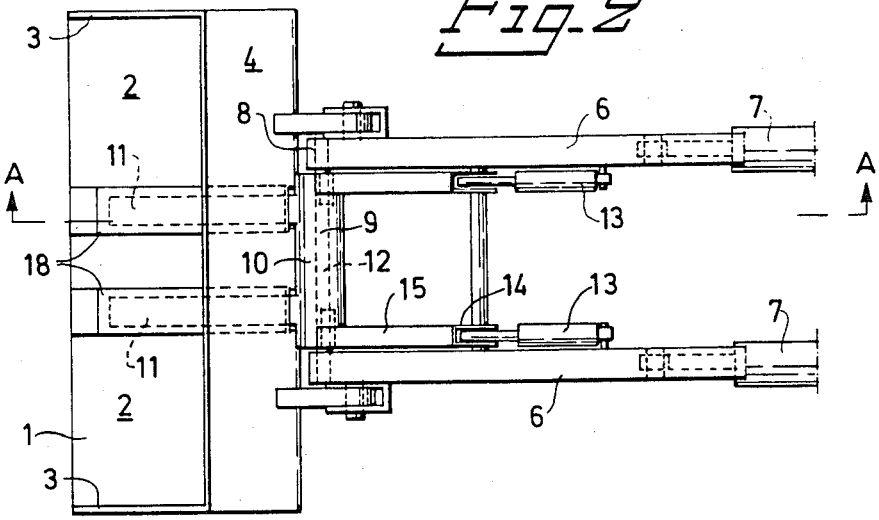
Figure 3:
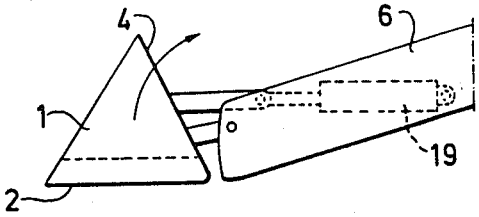
Figure 4:
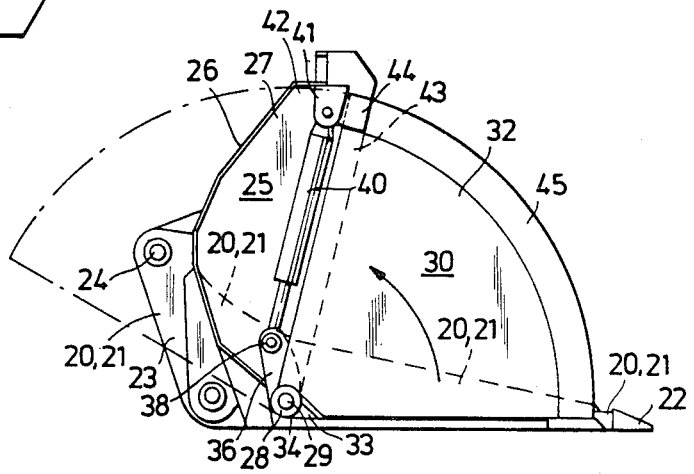
Figure 5:
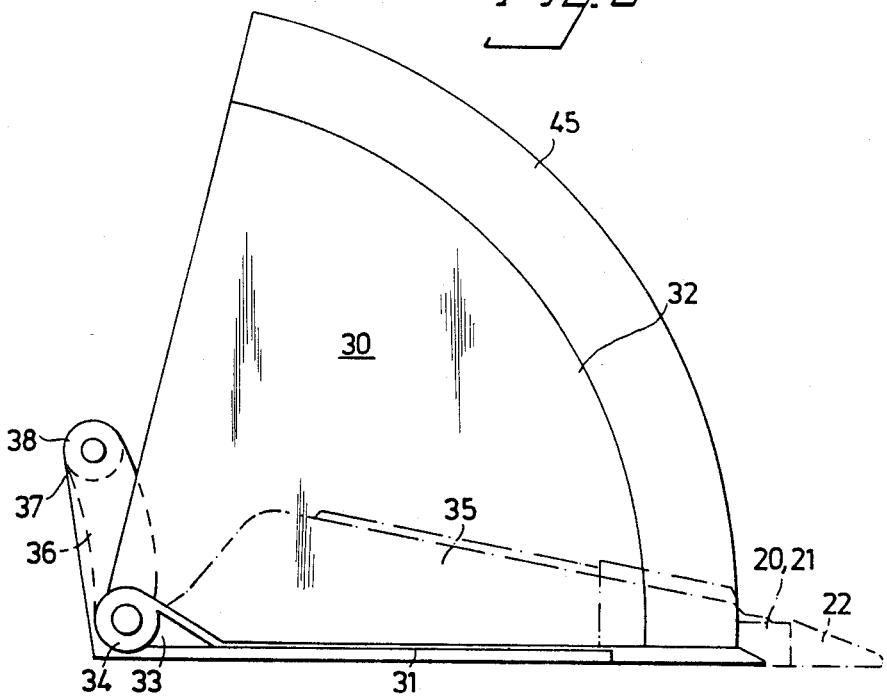
Figure 6:
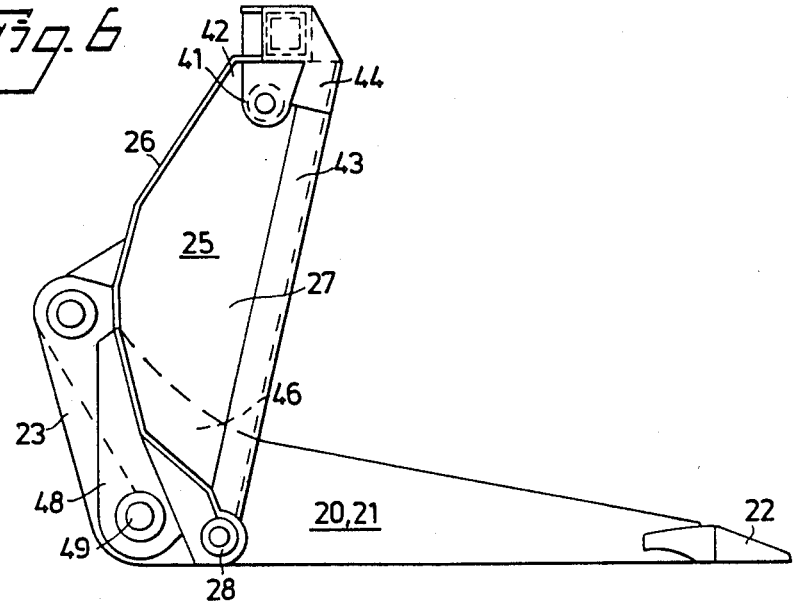
Figure 7:
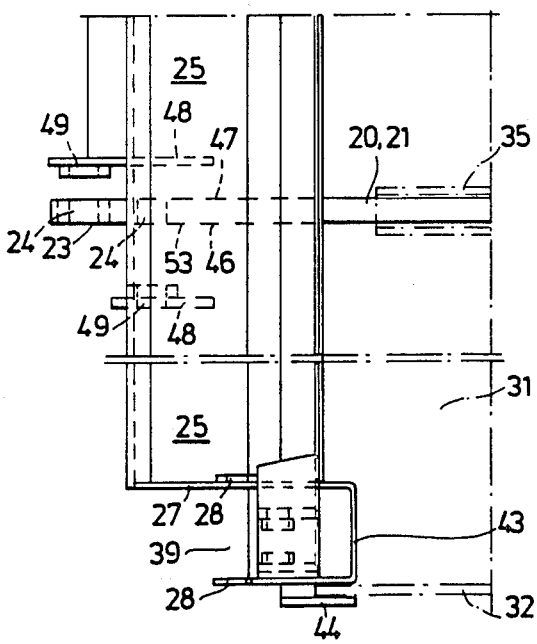
Figure 8:
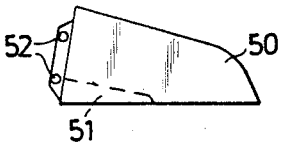

The invention is described in greater detail below with reference to an embodiment and to the accompanying drawings, in which:

FIG. 1 schematically shows an embodiment of a device according to the invention seen from the side, i.e. perpendicularly to the vertical plane, in which the bucket can be lifted and lowered, and in a section A—A according to FIG. 2, FIG. 2 schematically shows the device according to FIG. 1 seen from above in FIG. 1, FIG. 3 shows a detail of another embodiment where separate control means for the bucket are provided, FIG. 4 schematically shows a preferred embodiment of a combined bucket and lifting fork according to the invention, seen in the width direction of the bucket, FIG. 5 shows an enlarged forward portion of the bucket according to FIG. 4, seen as in FIG. 4, FIG. 6 shows an enlarged view of the fork arms and a back portion of the bucket according to FIG. 4, seen as in FIG. 4, FIG. 7 shows half the arrangement of back portion and arms according to FIG. 4, seen from above in FIG. 6, and FIG. 8 schematically shows a snow bucket intended to be attached to an arrangement of back portion and arms according to the invention.

In FIG. 1 a bucket, for example a so-called gravel bucket or transport bucket, is designated by 1, which bucket in known manner comprises a bottom 2, end walls 3, a rear wall 4 and an opening 5. The bucket 1 is intended to be attached to a vehicle (not shown), for example a tractor, and to be carried by preferably two lifting arms 6 extending in parallel with each other and capable by preferably hydraulic means, for example hydraulic cylinders 7, to be controlled so that the bucket by pivotal movement of the lifting arms 6 can be lifted and lowered in a substantially vertical plane. The bucket 1 is hingedly attached preferably to the free ends 8 of said lifting arms 6.

According to the invention, also a lifting fork 9, for example a so-called pallet fork, or corresponding member is provided at and projecting from the ends 8 of said lifting arms 6 carrying the bucket 1, which lifting fork is located substantially beneath the bucket 1. According to the embodiment shown in FIGS. 1 and 2, the lifting fork 9 comprises a cross-piece 10, which extends between the lifting arms 6, and from which the arms 11 of the fork 9 project. The lifting fork is attached hingedly to the lifting arms 6 by means of a through axle 12 or corresponding member extending between the lifting arms 6. For controlling the fork 9, in connection to each lifting arm 6 a hydraulic cylinder 13 is provided which via two link arms 14, 15, of which one 14 is hingedly attached to the lifting arm 6, act against a stay-shaped member 16 of preferably the cross-piece 10 for rotating the fork 9 about the axle 12.

The bucket 1 is hingedly attached to the ends 8 and capable in a first position to rest on the fork 9 with preferably portions of the bottom 2 of the bucket 1, and in a second position to be located folded upward in the direction away from the fork 9. The bucket 1 can here rest with its rear wall 4 on said lifting arms 6 or on supporting members 17 comprised in the lifting arms. In FIG. 1 said first position is shown by fully drawn lines and said second position by dashed lines. According to a preferred embodiment, the bottom 2 of the bucket 1 comprises a tunnel-shaped recess 18 for each one of the arms 11 of the fork. Also at a preferred embodiment, the bucket 1 is designed so that its bottom 2 constitutes a substantially vertical rear supporting wall when the bucket is in said second position and the fork assumes loading and transport position as shown in FIG. 1.

In FIG. 3 a hydraulic cylinder 19 is provided at a lifting arm 6 for folding the bucket 1 between said first and said second position. Preferably two cylinders 19 are provided.

At the preferred embodiment shown in FIGS. 4–8, the numeral 20 designates the arms of the liftinhg fork 21 comprised in the device. Each arm 20 is stronger than normal fork arms, for example of the type used as a frozen soil scarifier, and provided with a tooth at the forward end, which arms 20 are intended to be used, for example, for loosening the material to be handled by the device. Each arm 20 comprises at its rear portion an attachment portion 23 with attachment holes 24, for example an upper and a lower one, for co-operation with lifting arms and control means, for example hydraulic cylinders, of a tractor or similar vehicle. The fork 21 is capable to be controlled so that the arms 20 can be pivoted in substantially vertical planes.

According to the invention, the bucket comprised in the device includes two portions, a rear or back portion 25 located at the fork, the arms 20, in connection to the attachment portions 23. The back portion 25 comprises a rear portion 26, which extends in the width direction of the bucket and constitutes the back proper of the bucket, and two end wall portions 27 located at the rear portion 26 and extending forward, so that a bucket-shaped back portion 25 is formed.

The back portion 25, at its lower forward portion, comprises preferably a plurality of attachments 28 arranged in the width direction of the bucket. In the figures only the attachments 28 located in connection to the end wall portions 27 are shown. The attachments 28 are intended via at least one through axle 29 or the like to co-operate with similar attachments of the forward portion of the bucket, as described below.

According to the invention, the bucket as mentioned also comprises a forward portion 30, which comprises the bottom 31 of the bucket 25, 30 and end wall pieces 32 connected to said bottom. The forward portion 30 comprises at its rear, lower portion 33 attachments 34 intended to co-operate with the attachments 28, so that the forward portion is hingedly connected to the unit formed of the fork and back portion. The end wall pieces 32 preferably are sector-shaped, and the bottom 31 of the bucket includes elevated tunnel-shaped portions 35 for the arms 20 whereby the forward portion can rest on the arms.

Inside of each end wall piece 32 and in connection to an attachment 34 located adjacent the end wall piece, at least one rearward directed upward projecting link arm 36 is provided, which at its upper free end 37 comprises an attachment 38 for a hydraulic cylinder or the like to fold the forward portion 30 between said positions. It can be imagined that only said bottom 31 can be folded, in which case the end wall pieces 32 are comprised in the back portion 25.

On each side of the bucket, FIG. 7, a space 39 is formed between the end wall piece 27 and a plane located outside the end wall portion 27, in which plane the corresponding end wall piece 32 can be folded. In said space 39 at least one hydraulic cylinder, FIG. 4, for folding the forward portion 30 is provided, which cylinder acts between the attachment 38 and an attachment 41 of the upper portion 42 of the back portion.

Each space 39 is formed by means of a U-shaped beam 43 or corresponding member, which extends along the forward edge of the end wall portion 27, and which constitutes a protection for the cylinder 40 and comprises guide members, for example an outwardly and upwardly located guide plate 44, which is intended to co-operate with the edge portion 45 of an end wall piece 32, which guide members are capable to prevent deflection of the end wall piece 32 in the width direction of the bucket.

At the embodiment shown in FIGS. 4–8, the back portion 25 is rigidly attached to the arms 20, and the rear portions 46 of the arms extend through recesses in the back portion, so that the back portion co-operates a.o. with the sides 47 of these arm portions. Complementary attachment pieces 48 with attachments 49 are provided at the rear portion 26 of the back portion 25 in connection to the arms 20, as appears, for example, from FIG. 7. It is, however, possible to imagine embodiments, at which the back portion 25 is exchangeable at the arms 20, whereby the width of the bucket can be varied by using back portions with different width at the arms 20. The arms 20 and attachments, for co-operation with said lifting arms or corresponding members, preferably are located in a suitable way in a self-supporting stable structure (not shown), for example by means of cross-stays or the like extending between the arms in connection to the attachments. The back portion is made exchangeable in a suitable way, for example by means of attachments provided at the back portion to co-operate with the rear portion of the arms 11 and/or, when applicable, said self-supporting structure. Even at an exchangeable back portion 25, of course, complementary attachments 49 can be provided at the back portion.

The forward portion 30 preferably is arranged removable, in which case the foldable forward portion can be replaced, for example, by an unfoldable snow bucket 50, FIG. 5, which has a greater length than a foldable forward portion 30 and comprises tunnel-shaped spaces 51 for co-operation with the arms 20 and by means of attachments 52 at its rear portion, for example such as shown in FIG. 8, can be attached to the back portion 25.

According to a further embodiment of the device according to FIGS. 4–8, one or both arms 20 are movable in a suitable way in the width direction of the bucket, whereby the distance between the arms 20 can be adapted, for example, to the size of a stone or the like, which is to be loosened or lifted by means of the arms 20. Hydraulic cylinders preferably are provided for said movement, and in applicable cases the portions 53 of the back portion, which co-operate with the arm portions 46, are extended in the width direction of the bucket in an apparent manner, so that space is provided for said movement. It is, of course, possible to arrange one or several arms 11 movable even at the embodiments according to FIGS. 1–3.

The mode of operation of the device according to the invention substantially should have become apparent from the aforesaid. At the embodiment shown in FIGS. 1–3 the fork 9 is pivotal by means of the hydraulic cylinders 13. The fork can be pivoted downward to such an extent that the bucket can be tipped, and the fork can be pivoted upward to such an extent that the bucket 1 by means of the fork 9 can be caused to assume said second position. When separate control means 19 are provided for the bucket 1, the fork is not required to be pivoted upward to such an extent. When the bucket 1 is in said second position, the fork can be utilized for pallet lifting, lifting of cement pipes etc. When the bucket is in said first position, the bucket can be utilized in normal manner. It is also possible to grip objects between the fork 9 and the bucket 1 at least when separate control means 19 are provided. It is presupposed that the bucket and fork are designed and positioned so that a driver has an appropriate view from the driver's seat when the bucket assumes said second position and the fork 9 is in loading position.

As should have become apparent from the aforesaid, the device offers a simple and inexpensive solution of the problems referred to above in the introductory portion. The device saves very much time and work and is highly flexible in respect of its application range. At the preferred embodiment shown in FIGS. 4–8 is achieved that the operator has a very good view even when the forward portion is folded upward, i.e. at exposed fork, due to the folding-up of only said bottom and end walls where rotation occurs about a centre located in connection to said bottom. The structural design also is suitable for exchangeability of bucket portions whereby, for example, the bucket width can be varied. The exchangeability is facilitated by the arrangement of the control cylinders 40 at the bucket.

The invention has been described above with reference to some embodiments. It is, of course, possible to imagine more embodiments and minor alterations and completions without thereby abandoning the invention idea.

At the embodiment shown in FIGS. 1–3, the members, link arms etc. for pivoting the fork can be designed in some other suitable way, more precisely for example substantially in the same way, which is utilized for the control of known buckets. Locking means 54, for example, can be provided for locking the bucket in said second position where the locking means 54 by way of example are indicated comprised in the supporting members 17. The locking means may be mechanic, hydraulic etc. Due to the locking means, the bucket is retained in said second position not only because, as at the embodiment according to FIGS. 1 and 2, a vertical movement upward of the point of gravity of the bucket is required for moving the bucket from the second to the first position. Furthermore, especially at the embodiment according to FIGS. 1 and 2, said tunnel-shaped recesses 18 can be imagined to comprise friction-reducing members, such as rollers (not shown) or the like because a relative movement occurs between the "roof" 55 of the recesses and the upper surface of the fork arms when the bucket is operated by the fork. The bucket, preferably in connection to the recesses 18, can be completed with members (not shown), such as simple catches beneath the fork arms, by means of which catches the bucket and fork can be coupled together so that the bucket can be moved from said second position by means of the fork.

At a device according to the invention apparently more arms 11, 20 can be comprised in the fork. The arms 11, 20 can be of the reinforced type as shown in FIGS. 4–8, or they may be for example pallet fork arms of known kind.

Attachment portions and attachments for co-operation with said lifting arms 6 or corresponding members, of course, can be arranged in several ways. It is preferable to arrange the arms 11, 20 substantially directly in front of the lifting arms, wherby torsional moments about the longitudinal direction of the arms 6 are avoided.

The invention, thus, must not be regarded restricted to the embodiments set forth above, but can be varied within the scope of the attached claims.

I claim:

1. A device comprising a combined assembly of a lifting fork and bucket, which is intended to be attached to a vehicle, said assembly being carried by means of lifting arms extending parallel to each other, and wherein means including hydraulic means are provided for controlling said lifting arms and said bucket so that at least the forward portion of the bucket can be lifted and lowered in a substantially vertical plane and be tipped, wherein a lifting fork is carried by said lifting arms, said lifting fork being pivotable by a further hydraulic means so that the arms of said fork can be pivoted in planes substantially perpendicular to the width direction of said bucket, said fork being located substantially beneath said bucket and wherein at least said portion of the bucket is enabled by said hydraulic means to be folded to and from the fork between a first and a second position whereby the bucket, in said first position rests on the fork, and in the said second position is folded up away from said fork and back substantially completely away from the vertical zone above the fork arms so that said fork can be utilized in the conventional manner.

2. A device as defined in claim 1 wherein said first named hydraulic means includes a specific hydraulic means connected to and providing said controlling of said bucket, the bucket comprises a back portion, located at said fork connected to attachments for co-operation with said lifting arms, and a forward portion comprising the bottom of the bucket and end wall pieces connected to said bottom, and that the forward portion of the bucket is hingedly connected to the unit formed of the fork and back portion and foldable by said specific hydraulic means between a first position where said bottom is adjacent the arms of the fork and a second position where said bottom is adjacent the back portion.

3. A device as defined in claim 2, wherein said back portion comprises a rear portion extending in the width direction of the bucket substantially perpendicularly to the longitudinal direction of the fork arms, and two end wall portions located at the rear portion and extending forward so that a bucket-like back portion is formed.

4. A device as defined in claim 2, wherein the back portion at its lower portion comprises a plurality of attachments arranged in the width direction of the bucket, which attachments include a through axle to co-operate with similar attachments on the forward portion of the bucket.

5. A device as defined in claim 3, wherein the outer surface of each end wall portion comprises guide members located outwardly and upwardly and adapted to co-operate with the edge portion of an end wall piece, said guide members preventing deflection of the end wall piece in the width direction of the bucket and guiding the end wall piece during folding of the forward portion.

6. A device as defined in claim 2, wherein at each side of the bucket, between an end wall portion of the back portion and a plane located outside the end wall portion, in which plane the corresponding end wall piece is foldable, a space is formed, in which at least one hydraulic cylinder of said specific hydraulic means is provided for folding said forward portion, wherein each cylinder acts between an attachment on the lower portion of the forward portion and an attachment of the upper portion of the back portion.

7. A device as defined in claim 2, wherein, said back portion is removable.

8. A device as defined in claim 1 wherein the bucket is adapted in said second position to rest with its rear wall on supporting members comprised in the lifting arms.

9. A device as defined in claim 1 wherein locking members are provided for locking the bucket in said second position.

10. A device as defined in claim 1 wherein means are provided, by which the bucket and fork can be coupled together, so that the bucket can be moved from said second position by the fork.

11. A device as defined in claim 1 wherein the fork arms are of such size as to be able to loosen the material to be handled by the bucket, and each arm at its free end comprises an excavation tooth.

12. A device as defined in claim 1 wherein the arms of the fork are located substantially directly in front of said lifting arms, whereby torsional moments about the longitudinal direction of the lifting arms substantially are avoided.

13. A device as defined in claim 1 wherein at least a forward portion of the bucket is removable and replaceable by a snow bucket, which comprises tunnel-shaped spaces, into which the arms of the fork are intended to be inserted, and attachments, by means of which the snow bucket is intended to be attached the end wall portions of the back portions comprised in the bucket.

* * * * *